US006474248B1

(12) United States Patent
Stark et al.

(10) Patent No.: US 6,474,248 B1
(45) Date of Patent: Nov. 5, 2002

(54) HIGH SECURITY LOCK APPARATUS

(75) Inventors: Robert William Stark, 2332 Northwood Pulp Road, Prince George, British Columbia (CA), V2K 1K2; Helge Freudentheil, Prince George (CA)

(73) Assignee: Robert William Stark, Prince George (CA)

( * ) Notice: Subject to any disclaimer, the term of this patent is extended or adjusted under 35 U.S.C. 154(b) by 0 days.

(21) Appl. No.: 09/242,430

(22) PCT Filed: Aug. 15, 1997

(86) PCT No.: PCT/CA97/00581

§ 371 (c)(1),
(2), (4) Date: Dec. 10, 1999

(87) PCT Pub. No.: WO98/07939

PCT Pub. Date: Feb. 26, 1998

Related U.S. Application Data

(63) Continuation-in-part of application No. 08/698,731, filed on Aug. 16, 1996, now abandoned.

(51) Int. Cl.[7] ..... E05B 13/10

(52) U.S. Cl. ..... 109/59 R; 70/221; 70/224; 70/472; 70/DIG. 63

(58) Field of Search ..... 70/218, 221, 222, 70/DIG. 63, 224, 472, 215, 216, 422, 1.5; 109/59 R; 292/DIG. 27

(56) References Cited

U.S. PATENT DOCUMENTS

| | | | | |
|---|---|---|---|---|
| 1,374,908 A | 4/1921 | Davenport et al. | ..... | 70/222 |
| 1,560,503 A | 11/1925 | Doenges | ..... | 70/222 |
| 1,668,403 A | 5/1928 | Haven | ..... | 70/223 |
| 1,779,438 A | 10/1930 | Lowe | | |
| 1,911,564 A | 5/1933 | Gahagan | ..... | 70/218 |
| 1,915,353 A | 6/1933 | Bulleri | | |
| 2,013,055 A | 9/1935 | Kerwin, Jr. | ..... | 70/91 |
| 2,969,666 A | 1/1961 | Muessel | ..... | 70/116 |
| 3,343,386 A | 9/1967 | Hall | ..... | 70/423 |
| 4,113,291 A | 9/1978 | Cameron | ..... | 292/49 |
| 4,342,207 A | 8/1982 | Holmes et al. | ..... | 70/119 |
| 4,362,035 A | 12/1982 | Vitale | ..... | 70/165 |

(List continued on next page.)

FOREIGN PATENT DOCUMENTS

| | | | | |
|---|---|---|---|---|
| DE | 42559 | 3/1888 | | |
| DE | G9413552.5 | 12/1994 | | |
| EP | 0403099 A | 12/1990 | | |
| FR | 1203792 | 1/1960 | | |
| GB | 2 141 478 A | 12/1984 | | |
| GB | 2262700 A | * 6/1993 | ..... | 70/283 |
| GB | 2 286 223 A | 8/1995 | | |

*Primary Examiner*—Lloyd A. Gall
(74) *Attorney, Agent, or Firm*—Christie, Parker & Hale, LLP

(57) ABSTRACT

A high security lock apparatus comprises a deadbolt lock (70) having a lock body (71) and a deadbolt (73) extendible therefrom. A lock body support (67) cooperates with the lock body (71) to permit relative movement therebetween and has a deadbolt clearance opening (81) therein to receive the deadbolt (73) when aligned therewith. A doorbolt is operatively connected to the lock body support (67) and mounted for movement with respect to a complementary doorbolt stop in response to the relative movement. A tool receiver (77) cooperates with the lock body support (67) and receives an alignment tool (101) to generate the movement to align the deadbolt (73) with the deadbolt clearance opening (81) prior to extending the deadbolt (73). Preferably, the lock body (71) is journalled for rotation relative to the lock body support (67). The lock body support (67) preferably has an actuating arm (21, 22) extending therefrom and a doorbolt link extends from the actuating arm (21, 22) to the doorbolt to operatively connect them together to actuate the doorbolt. In this way, strength of the deadbolt itself does not effect overall strength of the high security lock apparatus.

31 Claims, 8 Drawing Sheets

U.S. PATENT DOCUMENTS

| | | | | | |
|---|---|---|---|---|---|
| 4,394,821 | A | * | 7/1983 | Best et al. | 70/224 X |
| 4,429,556 | A | | 2/1984 | Kambic | 70/149 |
| 4,435,967 | A | * | 3/1984 | Best et al. | 70/224 |
| 4,534,192 | A | | 8/1985 | Harshbarger et al. | 70/118 |
| 4,683,732 | A | | 8/1987 | Beattie | 70/118 |
| 4,690,073 | A | | 9/1987 | Shoop | 109/59 T |
| 4,936,122 | A | * | 6/1990 | Osada | 70/283 X |
| 5,230,230 | A | | 7/1993 | Horton | 70/1.5 |
| 5,245,846 | A | | 9/1993 | James | 70/118 |
| 5,542,273 | A | * | 8/1996 | Bednarz | 70/34 |
| 5,590,554 | A | | 1/1997 | Ho | 70/221 |

* cited by examiner

HIGH SECURITY LOCK APPARATUS

CROSS REFERENCE TO RELATED APPLICATION

This patent application is a continuation-in-part of application Ser. No. 08/698,731 filed Aug. 16, 1996, now abandoned.

BACKGROUND OF INVENTION

The invention relates to a high security lock, particularly for use with powder magazines or storing blasting explosives in remote wilderness areas, the explosives being used for mining, road construction, etc.

To reduce risk of unauthorized use or theft of explosives, the explosives are transported under relatively high security from a central explosive storage area to the remote magazine, which is typically a reinforced building with a door secured with a keyed lock. When unauthorized persons wish to break into such a building, the lock itself is often considered to be the weakest portion of the security system, and many locks commonly yield to forced entry by using relatively simple tools, e.g. a crowbar. Alternatively, often the door can be pulled open using a chain connected to the door and to a conventional pick-up truck. Because the building is located in a remote area, the unauthorized person usually has adequate time to effect the break in, and excessive noise is not a problem.

Government regulations require a lock of a certain standard to secure the door, but commonly such a lock can be easily forced and cost constraints prevent the use of more expensive and complicated locks. In addition, because the building is exposed to the elements, and often subjected to extreme temperatures, the lock itself cannot be excessively sophisticated or sensitive to excessive moisture or temperature fluctuations otherwise it would be prone to jam, and thus would be difficult for an authorized person to gain access to the explosives.

It is known to provide a locking apparatus in which a handle which activates a mechanism to move slideable door bolts to secure a door can be selectively disengaged from the mechanism to permit free rotation of the handle without actuating the door bolts. One such device is disclosed in German Patent Publication DE 94 13 552 U (Hoppe AG) which discloses a relatively complex structure in which an actuating handle can be disengaged from a mechanism to actuate door bolts when a key controlling the lock is rotated in one direction, and can be engaged when the key is rotated in an opposite direction. While such a structure might be appropriate in some relatively controlled environments, it would be inappropriate in the extreme temperatures to which powder magazines are exposed as it is relatively complex and vulnerable to forced entry.

U.S. Pat. No. 4,690,073 (Shoop) discloses a locking mechanism in which a pair of coupled locks are linked to a rotatable handle mechanism in such a way that the handle is free for rotation when the door is secured, and is engaged with door bolt actuating mechanism when the door is to be opened. The structure is relatively complex and occupies some considerable space on an inside surface of the secured door, and can be vulnerable to forced entry as the actuating handle for the door bolts is permanently secured to the door.

SUMMARY OF THE INVENTION

The present invention reduces the difficulties and disadvantages of the prior art by providing a high security lock apparatus in which the strength of the keyed lock has no bearing on the overall security of the locked door itself. The keyed lock can be a conventional Yale-type deadbolt lock which, when the lock apparatus according to the invention is secured, the deadbolt of the keyed lock is retracted, which contrasts with all locks known to the inventor in which, when the lock is secured, the deadbolt is always extended. When the deadbolt of the present invention is retracted, movement of external structure associated with the deadbolt does not open the door, and thus use of excessive force on the external structure associated with the deadbolt does not cause the door to be opened. In addition, the invention provides one or more doorbolts which can be suitably rugged and reinforced to secure the door within the door frame, the doorbolts being actuated by linkage structure which in turn is actuated by the keyed deadbolt in such a way that only when the deadbolt of the keyed lock is extended can the doorbolts be actuated.

A high security lock apparatus according to the invention is for controlling position of a moveable doorbolt with respect to a door, and comprises a deadbolt lock and a lock body support. The deadbolt lock has a lock body and a deadbolt extendible therefrom. The lock body support cooperates with the lock body to permit relative movement therebetween and has a deadbolt clearance opening therein to receive the deadbolt when extended and aligned therewith to prevent said relative movement. The lock body support is operatively connected to the doorbolt to selectively extend or retract the doorbolt when the deadbolt is extended and the lock body is moved.

The apparatus further comprises a tool receiver which can cooperate with the lock body support to receive an alignment tool for generating movement between the lock body and the lock body support to align the deadbolt with the deadbolt clearance opening. Preferably, the lock body is journalled for rotation relative to the lock body support, and also both the lock body and lock body support are rotatable about a main axis of the apparatus.

Preferably, the lock body support has an actuating arm extending therefrom and a doorbolt link extends from the actuating arm to the doorbolt to operatively connect them together to actuate the doorbolt. A secondary lock having a secondary lock body and a secondary bolt extendible therefrom can interfere with the lock body support to prevent movement thereof.

An alternative embodiment of the invention is a high security lock apparatus which comprises an engager, an engager body support, and a doorbolt. The engager has an engager body and is mounted for primary movement and has actuated and non-actuated conditions. The engager body support cooperates with the engager body to permit said primary movement between the engager and the engager body when the engager is non-actuated. The engager body is selectively positionable relative to the engager body support to prevent said movement when the engager is actuated. The doorbolt is operatively connected to the engager body support to be moved when the engager is actuated and moved.

An alternative lock apparatus according to the invention is for installation in a member and comprises a lock body having a body face with a key opening to receive a key. An access opening in the member extends from adjacent the key recess on the body face to an outside face of the member, the access opening being sufficiently large to receive the key for accessing the key hole, but being sufficiently small to prevent manipulation of lock picking tools.

A detailed disclosure following, related to drawings, describes embodiments of the invention which is capable of expression in structure other than that particularly described and illustrated.

DETAILED DESCRIPTION

Figure 1:
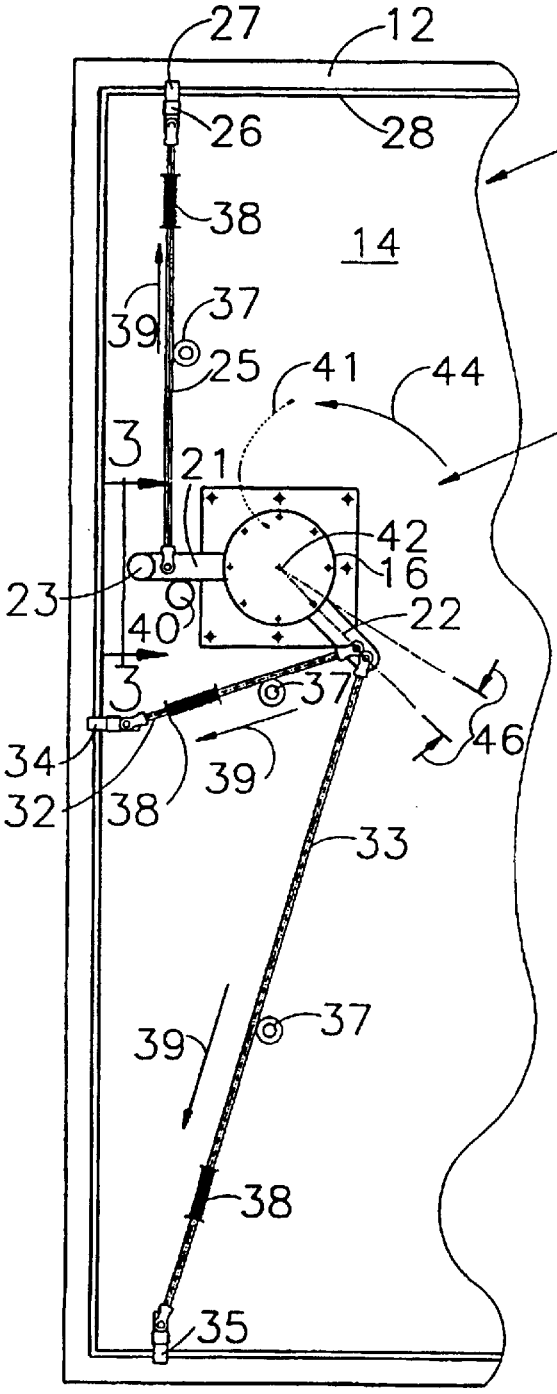
FIG. 1 is a simplified fragmented rear elevation of an interior face of a door, as seen from inside a powder magazine building, the door having a lock according to the invention shown with doorbolts thereof extended, the door being shown fitted within a door frame of the building.
Figure 2:
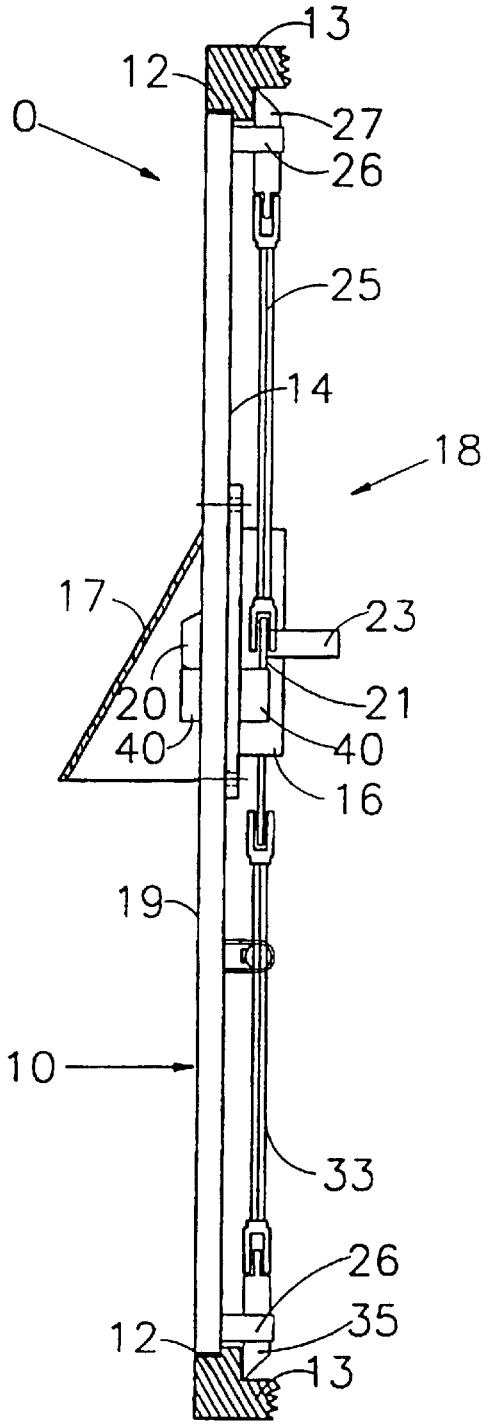
FIG. 2 is a simplified fragmented end elevation of the door and lock of FIG. 1, with the deadbolts shown extended.

FIGS. 1 and 2

A magazine door 10 is shown fitted within a magazine door frame 12 within a wall 13 of an explosives magazine. The door is hinged for normal swinging by hinges which are protected in the normal manner using security lugs on the door which fit into lug seats in the frame, none of which are shown.

A first embodiment of a high security lock apparatus 18 according to the invention has an interior lock casing 16 adjacent an interior face 14 of the door, and an exterior lock casing 20 adjacent an exterior face 19 of the door. A conventional sloping roof lock protector 17 extends over the exterior lock casing 20 to increase difficulty of unauthorized access into the lock as to be described. The lock apparatus 18 has first and second actuating arms 21 and 22 extending radially therefrom. An emergency handle 23 extends perpendicularly from the arm 21 and can be used to open the door by a person who is inadvertently locked in the magazine. A first doorbolt link 25 extends from the actuating arm 21 upwardly to a first doorbolt 27 which is mounted in a doorbolt guide 26 for sliding movement with respect to an adjacent upper edge 28 of the door. Generally similar second and third doorbolt links 32 and 33 extend from the second actuating arm 22 to cooperate with similar second and third doorbolts 34 and 35 respectively adjacent side and bottom edges of the door as shown. The links 25, 32 and 33 have generally similar washers 37 secured thereto in a plane generally parallel to the face 14 of the door, the washers serving as emergency engagement structure as will be described. Return coil springs and stops 38 cooperate with the links 25, 32 and 33 and the door to urge the links outwardly per arrows 39 to the extended position as shown. A ground strap 41 electrically grounds the lock to the door to reduce explosion risk from a static electrically generated spark. Following normal practice, the structure described above and provided adjacent the interior face of the door is protected by plywood sheeting (not shown) to isolate the magazine from accidental sparks. Only the emergency handle 23 projects through a complementary curved slot in the plywood which is shaped to accommodate movement of the handle.

The arms 21 and 22 are mounted for rotation about a central axis 42 of the lock apparatus as will be described with reference to FIGS. 3 through 6. Rotation of the arms 21 and 22 anticlockwise in direction of an arrow 44 through an angle 46, about 10 degrees, draws the doorbolt links 25, 32 and 33 away from the adjacent edges of the door, thus drawing the corresponding doorbolts 27, 34 and 35 inwardly so as to be generally flush with the edge of the door, permitting the door to be opened. Conversely, from the retracted position, rotation of the lock assembly in the clockwise direction extends the deadbolts to secure the door.

Figure 7:
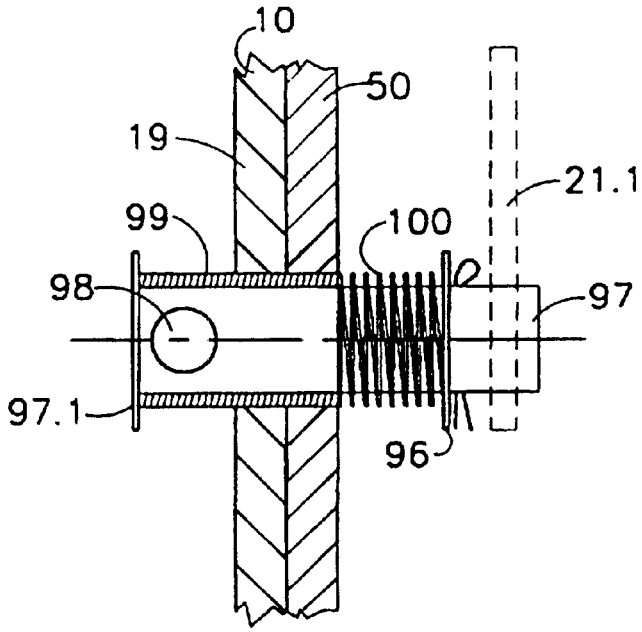
FIG. 7 is a simplified fragmented longitudinal section of a secondary lock.

In a small installation, only one doorbolt may be required, thus eliminating the need for other actuating arms and corresponding doorbolt links. In any event, each doorbolt is mounted for movement into and out of engagement with a complementary doorbolt stop, e.g. a recess or an edge of the door frame, as is common practice. An optional secondary lock 40 can be located adjacent the casing 20 and the arm 21 and can be actuated to interfere with the arm 21 (see FIG. 2) to prevent anticlockwise rotation of the arm 21, thus further preventing opening of the door as will be described with reference to FIG. 7. An alternative secondary lock is described with reference to FIGS. 10–15.

Figure 3:
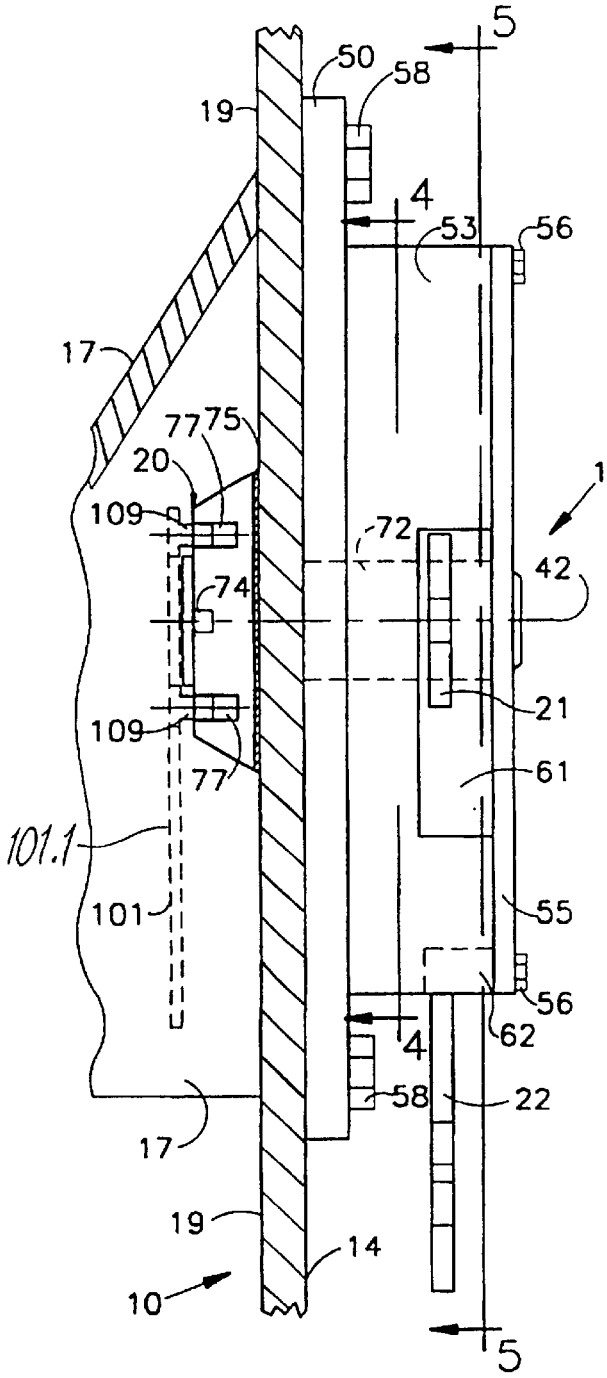
FIG. 3 is a simplified fragmented end elevation of the lock assembly according to the invention, generally similar to FIG. 2 and as seen from line 3—3 of FIG. 1, with actuating links and other structure being removed.
Figure 4:
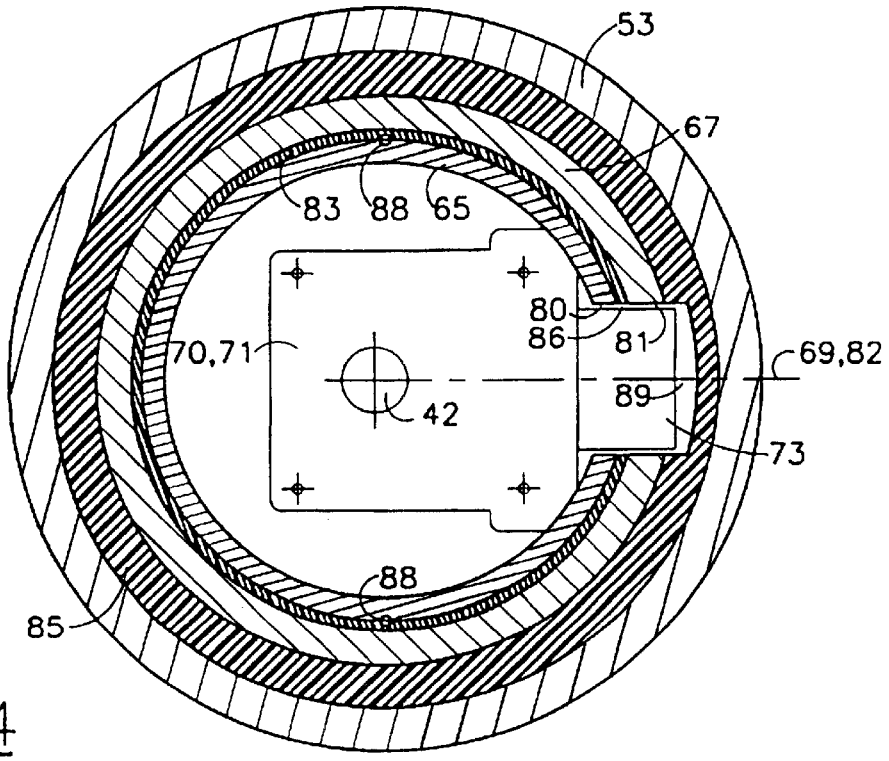
FIG. 4 is a simplified fragmented section as seen from line 4—4 of FIG. 3.

FIGS. 3 and 4

The interior lock casing 16 comprises a mounting flange 50, an outer hollow cylindrical casing 53 and a circular casing cover 55 secured to the cylindrical casing 53 by bolts 56. The mounting flange 50 is preferably secured to the interior face 14 of the door by welding, or alternatively a plurality of flange bolts 58. The outer cylindrical casing 53 has clearance openings 61 and 62 to receive the first and second actuating arms 21 and 22 respectively extending therethrough, the openings having sufficient circumferential length to accommodate limited swinging motion of the arms 21 and 22 through the angle 46 as described with reference to FIG. 1. The lock apparatus further comprises an inner ring member 65 and an intermediate ring member 67, the members 65 and 67 and the casing 53 having cylindrical walls and being concentric with the axis 42.

A conventional primary keyed deadbolt lock 70, such as a Yale-type cylinder lock, is mounted within the inner ring member 65 for movement therewith as will be described with reference to FIG. 6. The deadbolt lock 70 has a lock body 71 containing a lock cylinder 72, a deadbolt 73 extendable from the body 71 along a deadbolt axis 69, and a key opening 74 typical of conventional locks of this type. The lock cylinder extends between interior and exterior lock casings 16 and 20 as is common practice, but is rotatable with the casing 16 relative to the door about the axis 42 as will be described with respect to FIGS. 5 and 6.

A relatively thin plastic washer 75 is fitted between an inner face of the exterior lock casing 20 and the exterior face 19 of the door, and is made from a low friction material to reduce friction therebetween and to reduce or eliminate ingress of moisture between the two surfaces.

The exterior casing 20 has a pair of diametrically spaced tool openings 77 adapted to receive an alignment tool for rotating the lock body, as will be described with reference to FIGS. 8 and 9. A diameter, not shown, passing through the openings 77 can be considered to be an alignment datum of the lock apparatus and is critical. The casing 20 or the door face 19 has angular graduations (not shown) to ensure correct orientation of the tool based on the alignment datum as will be described.

The ring members 65 and 67 have deadbolt clearance openings 80 and 81 respectively which, as shown in FIG. 4, are aligned to receive the deadbolt 73 extending therethrough. A relatively thin, first plastic journalling ring 83 is provided between the ring members 65 and 67 to permit unlimited relative rotation therebetween when the deadbolt is retracted to permit alignment of the deadbolt axis 69 with an axis 82 of the clearance opening 81 in the intermediate member 67. The ring 83 is preferably made from a low friction polyurethane elastomer, Nylon™ or a Teflon™ type material. A pair of diametrically opposed and axially disposed retaining screws 88 are fitted between the first journalling ring 83 and the inner ring member 65 to prevent relative rotation between the journalling ring 83 and the ring member 65, thus ensuring that the relative rotation occurs between the plastic ring 83 and the intermediate ring member 67. The clearance opening 81 and respective axis 82 thus rotate with the ring member 67 when engaged by the deadbolt. For each example of a lock, to increase difficulty of forced entry, the axis 82 is disposed at a specific angle with respect to the alignment datum associated with the tool openings 77 as will be described with reference to FIGS. 8 and 9.

Figure 5:
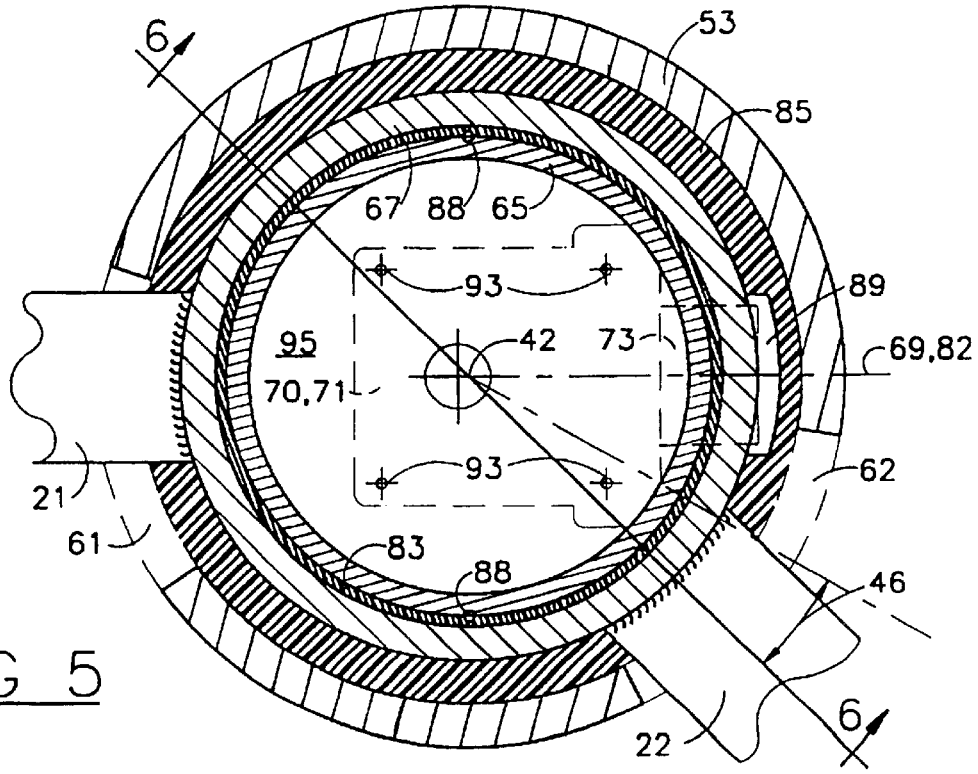
FIG. 5 is a simplified fragmented section as seen from line 5—5 of FIG. 3.

A thicker, second plastic journalling ring 85 is located between the outer cylindrical casing 53 and the intermediate ring member 67 to permit limited rotation therebetween through the angle 46, FIG. 1. The second plastic ring 85 has a clearance notch 89 to receive the deadbolt 73 when extended, and is located to be aligned with the deadbolt by diametrically opposite portions of the ring 85 embracing opposite edges of the first actuating arm 21 as best seen in FIG. 5. In this way the ring 85 rotates with the intermediate member 67, thus ensuring that there is relative rotation between the ring 85 and the cylindrical casing 53. Preferably, the ring 85 is also made from Teflon™, Nylon etc, although in some cases glass reinforced synthetic resin, e.g. fibreglass can be substituted. In summary, the ring member 67 and the ring member 65 are journalled for rotation within the casing 53 and the ring member 67 respectively, both for rotation about the axis 42.

The use of plastic rings is important, not only to reduce friction during rotation, but to essentially eliminate the chance of static electricity being generated, causing possible sparks. In addition, no lubrication is required and if an unauthorized person attempts forced entry into the lock using extreme heat, for example an oxyacetylene torch, the plastic can melt which would result in seizure of the lock and prevent unauthorized access.

A clearance opening 86 and the clearance notch 89 are provided in the journalling rings 83 and 85 respectively and aligned with the clearance openings 80 and 81 respectively to receive the deadbolt 73 extended and are generally similar to the clearance openings in the ring members 65 and 67.

Figure 6:
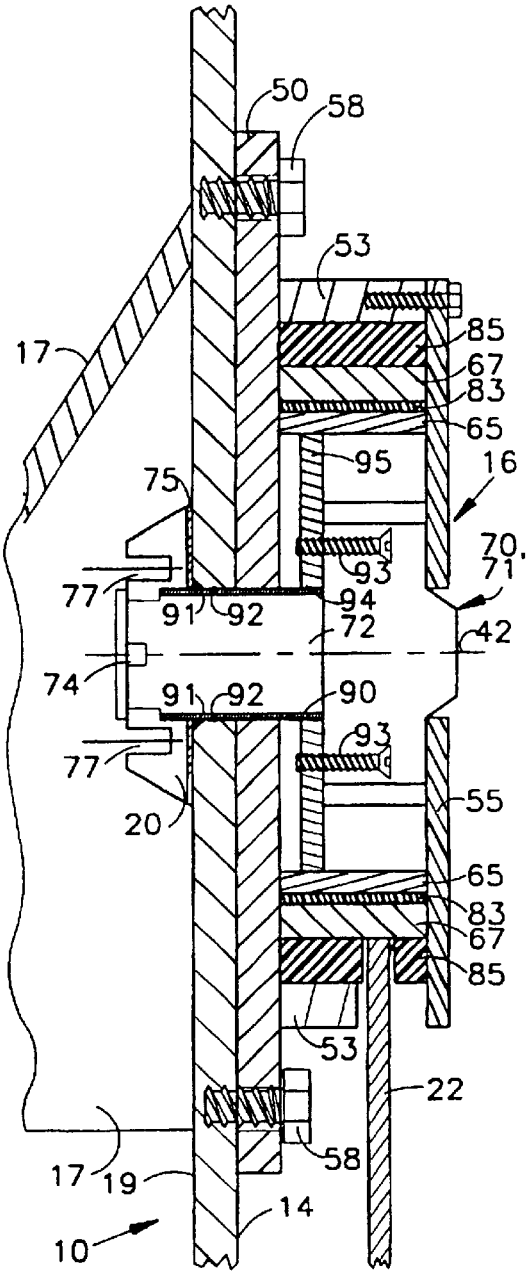
FIG. 6 is a simplified fragmented section as seen from line 6—6 of FIG. 5.

FIGS. 5 and 6

The lock cylinder 72 is fitted within a complementary steel sleeve 90 fitted to rotate within a complementary opening in the door 10. An annular plastic seal 91 is located between the washer 75 and a shallow groove surrounding the complementary opening in the door 10 which further prevents ingress of moisture into the lock. A relatively small O-ring seal 92 is located between the opening in the door 10 and the steel sleeve 90 to further prevent moisture entering the lock structure. The keyed deadbolt lock 70 has lock securing screws 93 which pass through the body 71 into a generally circular backing plate 95 which is secured to an inside surface of the inner ring member 65. The backing plate has central opening 94 to receive the cylinder 72 as shown, which also passes through undersigned aligned openings in the mounting flange 50 and the door so as to extend into the exterior lock casing 20. The steel sleeve 90 has an outer end secured to the exterior lock casing 20 and an inner end secured to the backing plate 95. Thus, the exterior lock casing is secured to the lock cylinder so as to rotate therewith, so that the assembly of the exterior lock casing 20, the lock body 71 and cylinder 72, the sleeve 90, the backing plate 95 and the ring member 65 rotate together with respect to the door and the interior lock casing 16 when the deadbolt 73 is retracted. It can be seen that the casing 16, the ring member 65, the lock body 71, the sleeve 90, the cylinder 72 and the backing plate 95 act as an integral unit, and the intermediate ring member 67 serves as a lock body support which cooperates with the said integral unit to permit relative movement between the lock body and the lock body support. Because the ring member 65 and lock body 71 are essentially integral, the clearance opening 80 of the ring member 65 is always aligned with the deadbolt 73. Clearly, the lock body support has the deadbolt clearance opening 81 therein to receive the deadbolt 73 only when aligned therewith after appropriate relative rotation. In addition, as stated earlier, opposite edges of the actuating arm 21 are embraced by faces of the second plastic ring 85, which locates the ring with respect to the intermediate ring member 67 ensuring that the clearance notch 89 is always aligned with the deadbolt 73.

The second actuating arm 22 is secured to the intermediate ring member 67 and extends generally radially therefrom through the opening 62 to rotate with the ring member 67. Similarly, the actuating arm 21 is secured to the intermediate ring member 67 to extend through the clearance opening 61.

FIG. 7

The secondary lock 40 has a plunger 97 with a transverse opening 98 which is accessible from and located closely adjacent to the door exterior face 19. The transverse opening 98 receives a shackle of a conventional padlock or other separable lock (not shown) as will be described. The plunger is mounted for axial sliding within a tubular lock body 99 secured perpendicularly to the door 10. The lock body 99 has an opening, not shown, which is aligned with the opening 98 to receive the shackle when the plunger is retracted. A compression coil spring 100 is fitted between a captive washer 96 and body 99 to urge the plunger inwardly to interfere with the arm 21, position of which is shown in broken outline at 21.1, and represents the location of the arm as shown in FIG. 1. The plunger 97 has a disc 97.1 at an outer end for gripping by the operator to draw the plunger outwardly against the spring force. It can be seen that the secondary lock effectively has a secondary lockbolt, that is the plunger 97, which is extendible from the secondary lock body 99 to interfere with the lock body support, i.e. the arm 21 extending from the ring member 67 to prevent movement thereof. When the lock 40 is actuated, that is locked, the plunger 97 of the lock extends inwardly from the door interior face 14 to interfere with the arm 21 to prevent rotation in direction of the arrow 44. When the plunger 97 is retracted, interference with the arm 21 is removed to permit rotation of the members 65 and 67 per the arrow 44 of FIG. 1.

Figure 8:
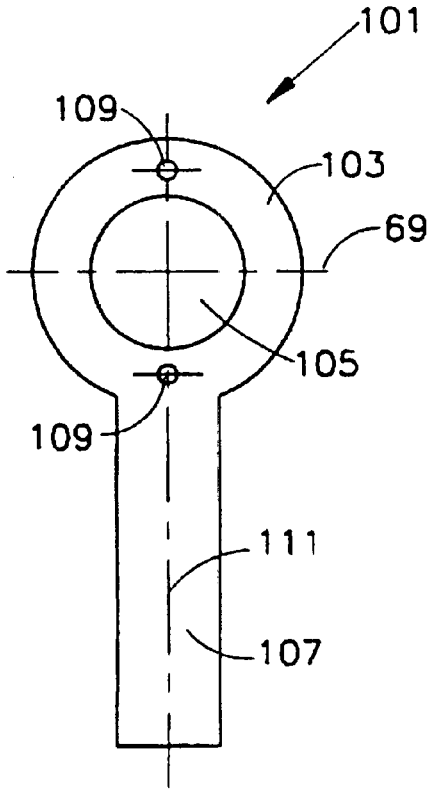
FIG. 8 is a front elevation of a first embodiment of an alignment tool.
Figure 9:
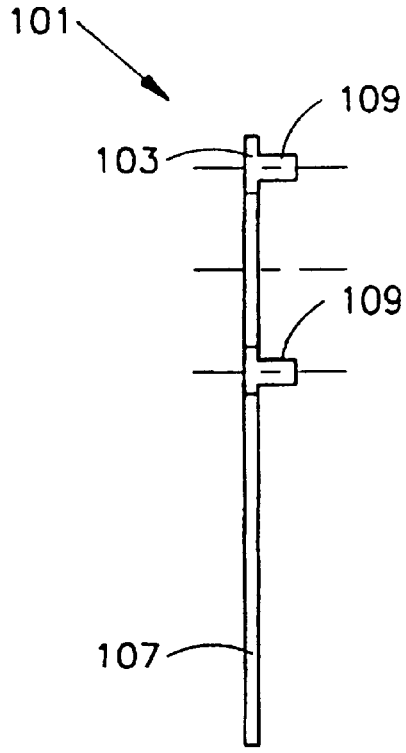
FIG. 9 is a side elevation of the tool of FIG. 8.

FIGS. 8 and 9, with reference to FIG. 3

The lock according to the invention requires an alignment tool 101 which comprises a ring portion 103 having a central opening 105 which has a diameter somewhat greater than an outer portion of the lock cylinder 72 to enable the tool to fit closely adjacent an outer face of the exterior lock casing 20, as seen in broken outline at 101.1 in FIG. 3. The alignment tool 101 has a handle portion 107 extending radially from the ring portion, and a pair of engaging pins 109 which extend axially from diametrically opposite locations of the ring portion and are sized and spaced apart to be received in the tool openings 77 of the exterior lock casing 20. Thus, as shown in broken outline in FIG. 3, when the tool 101 is closely adjacent the casing the pins 109 are received in the tool openings 77. It can be seen that the tool openings 77 in the exterior lock casing 20 serve as a tool receiver which cooperate with the lock body to receive the alignment tool for generating movement between the lock body 71 and the lock body support, that is the intermediate ring member 67, to align the deadbolt with the deadbolt clearance opening 81. The handle portion 107 is aligned with the alignment datum interconnecting the tool openings 77 which receive the pins 109 as previously described. The alignment datum is designated 111 in FIG. 8 and is used to determine the angular orientation of the lock body and thus the deadbolt axis 69 with respect to the door. In the present example, the axis 69 of the deadbolt is shown to extend as right angles to the alignment datum 111 so that when the handle portion 107 points to "6 o'clock" the deadbolt axis points to "9 o'clock" when viewed looking at the door 10 from the outside.

OPERATION

To open the magazine door, certain particulars of the high security lock apparatus 18 must be known to the operator, apart from having the two keys for the primary keyed deadbolt 70 and the padlock on the secondary lock 40 respectively, and the alignment tool 101. The operator must be aware of the specific relationship of angles of the clearance opening 81 with respect to alignment of the tool openings 77 in the exterior lock casing 20. Knowledge of the specific angular graduations on the casing 20 or face 19 ensures that the casing 20, and thus the lock body 71 can be correctly oriented to ensure that the deadbolt 73 can extend into the clearance opening 81, similarly to a rotatable dial combination lock. Clearly, each particular lock can be "customized" to provide a different combination of keys and angles, thus reducing chances of inadvertent duplication of combinations.

When the magazine door is fully locked, the deadbolt 73 is retracted to as to be clear of the clearance opening 81 in the intermediate ring member 67. In this locked condition the inner ring member 65 is free to rotate when the exterior lock casing 20 is rotated, either by use of the alignment tool 101, or by an unauthorized operator gripping the tapered exterior lock casing 20 with a suitable tool and causing rotation thereof. In contrast with prior art locks, where forced rotation of the typical external lock structure equivalent to the exterior lock casing 20 would normally break the lock, in the present invention authorized or unauthorized rotation of the casing 16 has no affect on opening the door or damaging the lock.

To open the door, it is assumed that the secondary lock 40 has been activated and is secured with a padlock having a shackle passing through the opening 98. The padlock is first unlocked so that the shackle can be removed from the opening 98, and the plunger 97 is then drawn outwardly from the door by gripping the disc 97.1, thus compressing the spring 100 and removing interference from the arm 21. The padlock can be reinserted through the transverse opening and held against an outer edge of the secondary lock body 99 which prevents the spring from extending the plunger to interfere with the arm to permit movement of the arm. The operator then inserts the pins 109 of the tool 101 into the tool openings 77 of the casing 20 as seen in FIG. 3. The operator then rotates the exterior lock casing 20 to the correct angular orientation of the handle portion 107 based on the angular graduations on the casing 20 or door face 19 so that the tool openings 77, i.e. the lock body and deadbolt, are aligned with a known predetermined angular orientation. Clearly, alignment with the clearance opening 81 is normally impossible to see or detect by a person trying to open the lock.

When the correct angular orientation of the handle portion 107 is attained, a conventional Yale-type key is inserted in the deadbolt key opening 74 and rotated to extend the deadbolt so as to engage the aligned clearance opening 81 and the clearance notch 89. The tool 101 is then rotated per the arrow 44 through the angle 46 (FIG. 1) (approximately 10 degrees) which swings the actuating arms 21 and 22 to draw the doorbolt links 25, 32, and 33 away from adjacent edges of the door, thus drawing the corresponding doorbolts inwardly into the door, so as to disengage the door frame.

To lock the door, the reverse procedure is followed, it being understood that the doorbolts can only be extended when the deadbolt 73 passes into the clearance notch 89 to permit rotation of the actuating arms 21 and 22.

In an emergency, for example if the keyed deadbolt lock 70 becomes damaged so that the deadbolt 73 cannot be extended therefrom, or if the doorbolts cannot be retracted for some reason, an emergency or backup opening system is provided using the washers 37 secured to the doorbolt links 25, 32 and 33 as follows. When each lock is installed on a particular door, care is taken to ensure that, when the doorbolts are extended, the exact locations of the openings of the washers 37 with respect to the edges of the door are measured and recorded. In this way, it is possible to drill through the door accurately to provide and access opening adjacent to any of the washers 37. When a hole has been drilled through the door, a suitable prybar is provided to engage the opening within the adjacent washer 37. The prybar is pried to force the specific link axially, which in turn moves all the links and corresponding doorbolts away from clearance openings, so as to forcibly retract all the doorbolts and thus permit the door to be opened in this alternate manner. It can be seen that the washers serve as an engagement structure which cooperates with the doorbolt link to receive an emergency tool, that is the prybar, to actuate the link independently of actuation of the keyed deadbolt. After opening the door in this manner, the specific washer is removed from the doorbolt link and the aligned drilled hole is filled by welding, thus preventing reopening of the door using this same location. Because several washers are provided on different links, an alternate washer is still available should emergency opening be necessary again.

ALTERNATIVES

The invention is particularly described for use with a powder magazine located in a remote wilderness area, but clearly an equivalent structure can be used for protecting doors of small, high security containers such as safes as used in buildings, or safe boxes used for transporting explosives. In any event, the safe housing has a door opening defined at least partially by the door frame with the safe door moveable with respect to the door frame to close the door to protect the contents of the safe housing. Clearly, a sliding door could be used equally as a hinged door with modifications to the deadbolt and action of the lock body support as is well known.

While the body of the keyed deadbolt lock 70 has been shown to be mounted in the ring member 65 for rotation relative to the intermediate ring member 67, clearly other alternatives can be devised to permit an alternative relative movement between the body of the keyed deadbolt lock and the associated structure. In the present structure as described, the lock body 71 is rotatable about the main axis, namely the central axis 42, and the lock body support, i.e. the ring member 67, is also rotatable about the main axis. Both members at least partially enclose the lock body. Journals for journalling the lock body for rotation relative to the lock body support, termed primary rotation, are provided by the plastic journalling ring 83 which permits relatively free unlimited rotation of the inner ring member 65 with respect to the intermediate ring member 67. The ring 85 provides journals to permit limited rotation between the intermediate ring member 67 and the door to move the door bolts, termed secondary rotation. It is considered mechanically desirable to use rotation to provide relative movement between the body of the deadbolt lock, the lock body support and the door, but clearly lineal sliding or another motion could be substituted. In any event, there is a primary relative motion between the lock body and lock body support to achieve alignment for engagement by the deadbolt, and a secondary relative motion between the lock body support and the door to move the doorbolts. Clearly, one or both of these motions could also be lineal to move the doorbolts. Also, a combination lock, or an electronically actuated lock or other means to move a deadbolt into engagement with a deadbolt clearance opening in the lock body support can be substituted for the Yale type lock. The invention also requires at least one doorbolt operatively connected to the lock body support.

The primary keyed deadbolt lock 70 of the present invention can be a conventional mechanical lock having a deadbolt 73 moveable axially of the lock body 71. In yet another alternative, a high security lock apparatus comprises an engager, an engager body support and a door bolt. The engager has an engager body and is mounted for primary movement and has actuated and non-actuated conditions. The engager body support cooperates with the engage body to permit said primary movement between the engager and the engager body when the engager is non-actuated. The engager body is selectively positionable relative to the engager body support to prevent said movement when the engager is actuated. The door bolt is operatively connected to the engager body support to be moved when the engager is actuated and moved. A lock of this type might require magnetic or other non-mechanical or non-direct actuation, but this alternative might best be used in circumstances less rugged than those of the mechanical lock described above. In addition, while the present invention shows a primary and secondary deadbolt, as well as a doorbolt mounted on the door, clearly the structure could be rearranged with the locks and deadbolts mounted on the door frame so as to engage the door.

Figure 10:
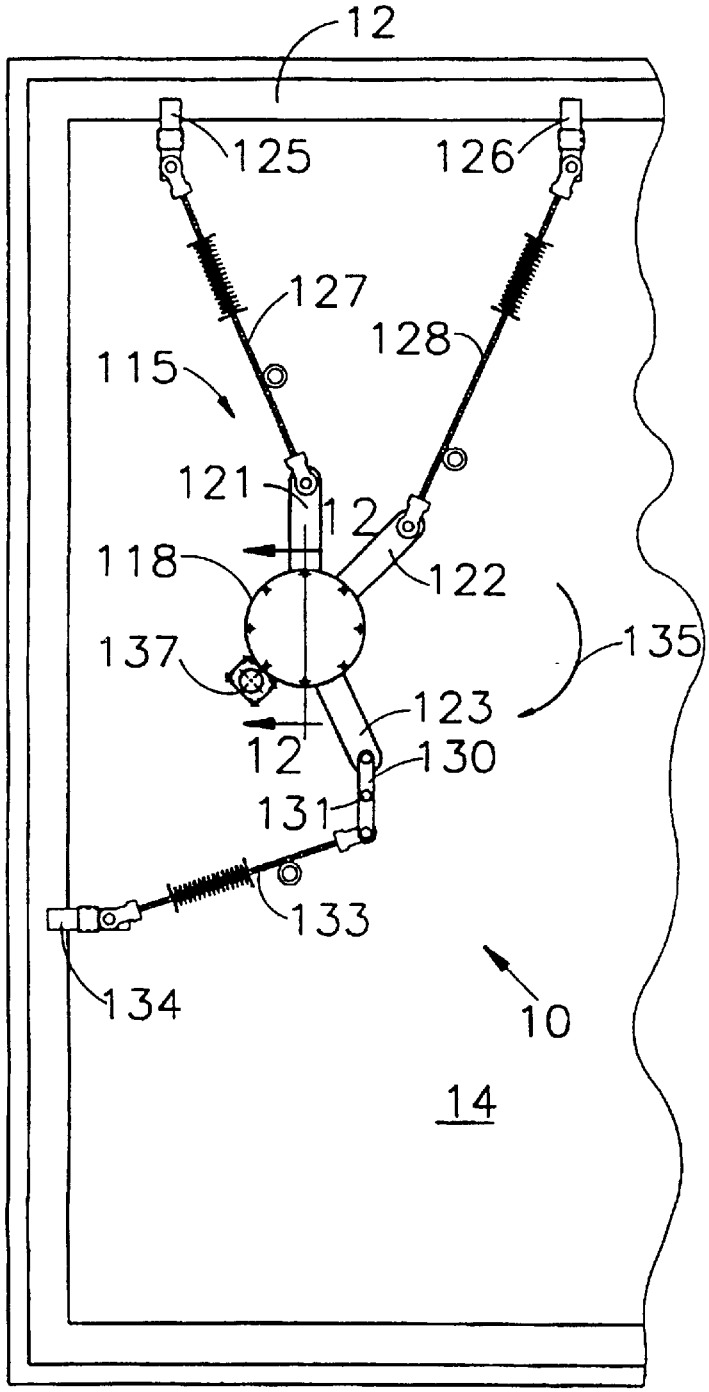
FIG. 10 is a simplified fragmented rear elevation of an interior face of a door which is generally similar to the view shown in FIG. 1, with a second embodiment of a lock apparatus according to the invention shown with doorbolts extended.
Figure 11:
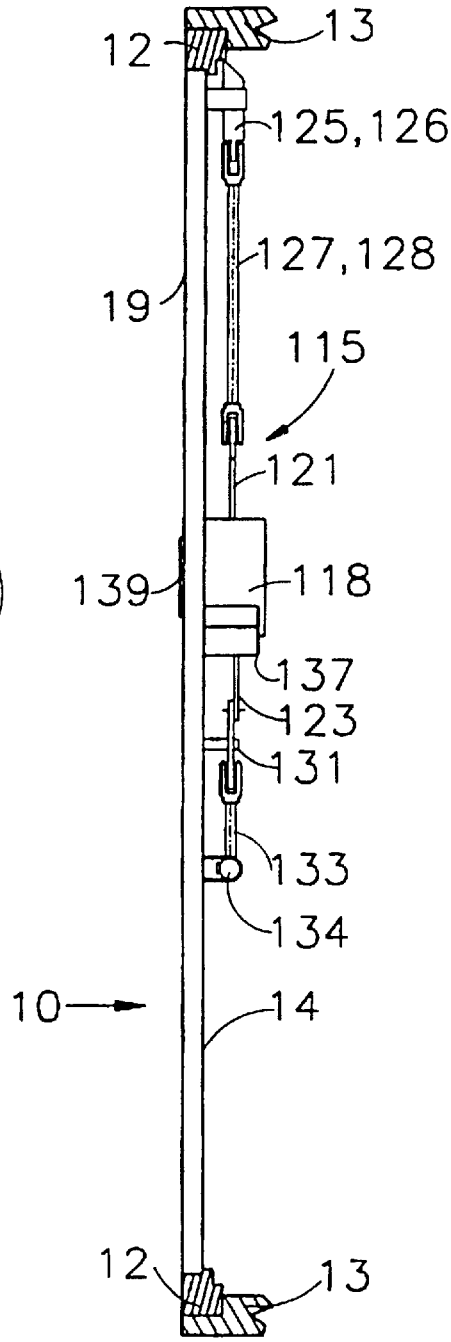
FIG. 11 is a simplified fragmented end elevation of the door and lock apparatus of FIG. 10 with one deadbolt shown extended.

FIGS. 10 and 11

A second embodiment 15 of a high security lock apparatus according to the invention has many similarities to the first embodiment 18 in FIGS. 1 through 9, but also has some differences which provide additional advantages over the first apparatus. The second alternative apparatus 115 has a primary lock casing 118 secured to the interior face 14 of the magazine door 10 which as previously described is hinged to a door frame 12 within the wall 13 of the magazine. If desired, the lock protector hood 17 of FIG. 2 can be omitted as shown and no portions of the lock protrude from the door, so that the exterior face 19 of the door is essentially flat, thus increasing difficulty of forcing the door or the lock. If the exterior face of the door has no protrusions and only small recesses as will be described, there is no anchor for attachment of a chain hooked to a truck which is the conventional approach for breaking into a magazine.

Similarly to the lock apparatus 18, the lock apparatus 115 has first, second and third actuating arms 121, 122 and 123 respectively extending radially from the casing 118, the actuating arms 121 and 122 cooperating with first and second doorbolts 125 and 126 through doorbolt links 127 and 128 respectively. In contrast, the third actuating arm 123 cooperates with a pivoted link 130 which rotates about a pivot 131 and has an opposite end connected to a third doorbolt link 133 extending to a third doorbolt 134. The link 130 is a reversing means to ensure that the three actuating links operate compatibly. Clearly, rotation of the actuating arms in direction of an arrow 135 simultaneously retracts or draws the doorbolts inwardly to permit opening of the door, and reverse rotation extends the doorbolts. In this alternative, there is no lower doorbolt cooperating with the lower edge of the door corresponding to the doorbolt 35 of FIGS. 1 and 2. This is to eliminate problems of possible dirt contamination which can arise in wilderness situations, but would not be a concern in many other applications.

In contrast with the first embodiment 18, the second embodiment 115 has a secondary lock casing 137 which is closely adjacent the primary lock casing 118 and is described in greater detail with reference to FIGS. 12 through 15. A graduated disc 139, shown diametrically in section in FIG. 11, is secured to the exterior face 19 of the door and has radially extending graduations resembling a clock face. These are used for tool alignment purposes to open the lock as will be described similarly to the previously described embodiment. Other aspects of the door frame and lock are generally similar to those previously described.

FIGS. 12–15

Figure 12:
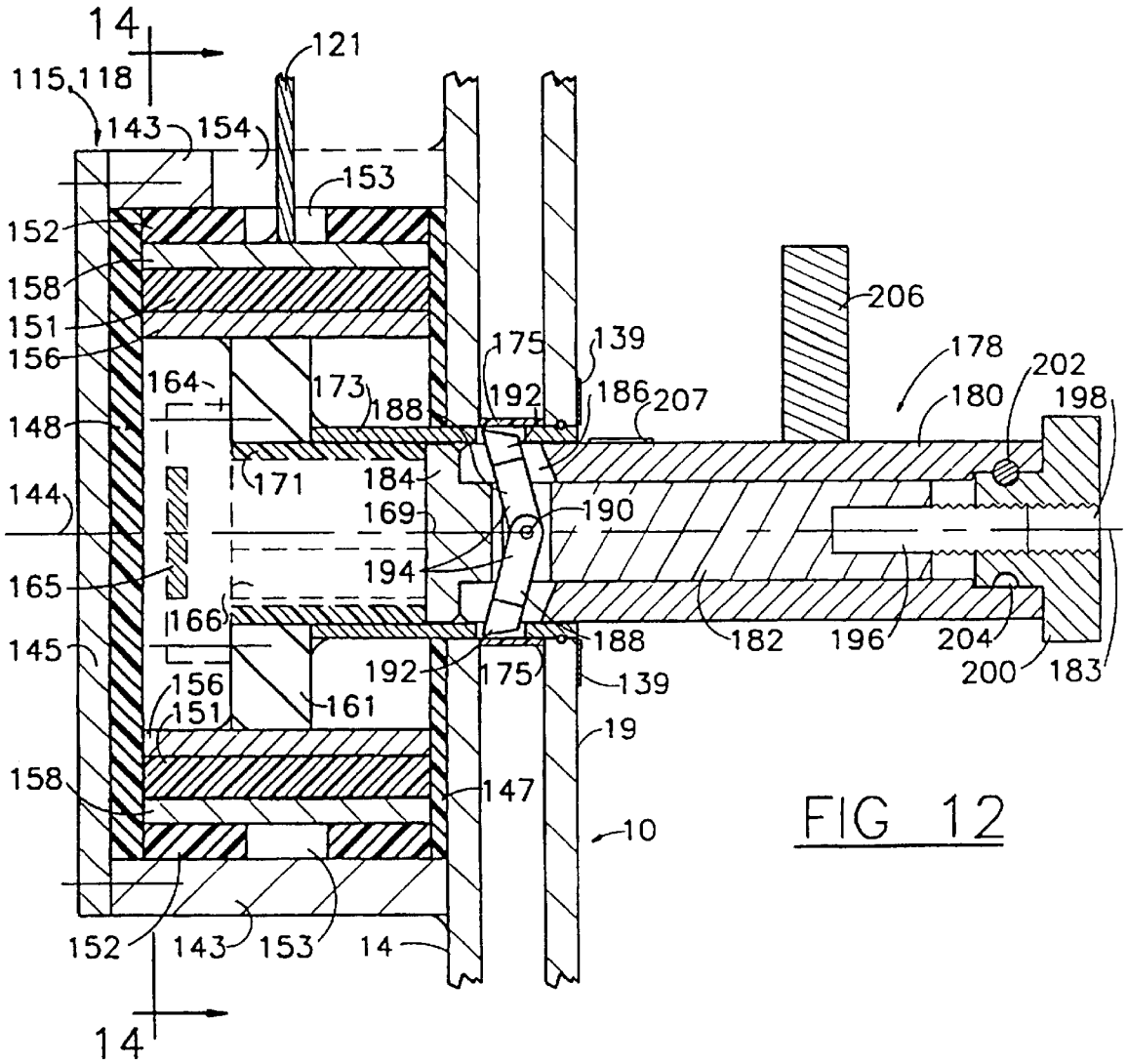
FIG. 12 is a simplified fragmented section generally on line 12—12 of FIG. 10, showing internal details of the second embodiment and a second embodiment of an alignment tool shown extended and cooperating with the lock assembly.
Figure 14:
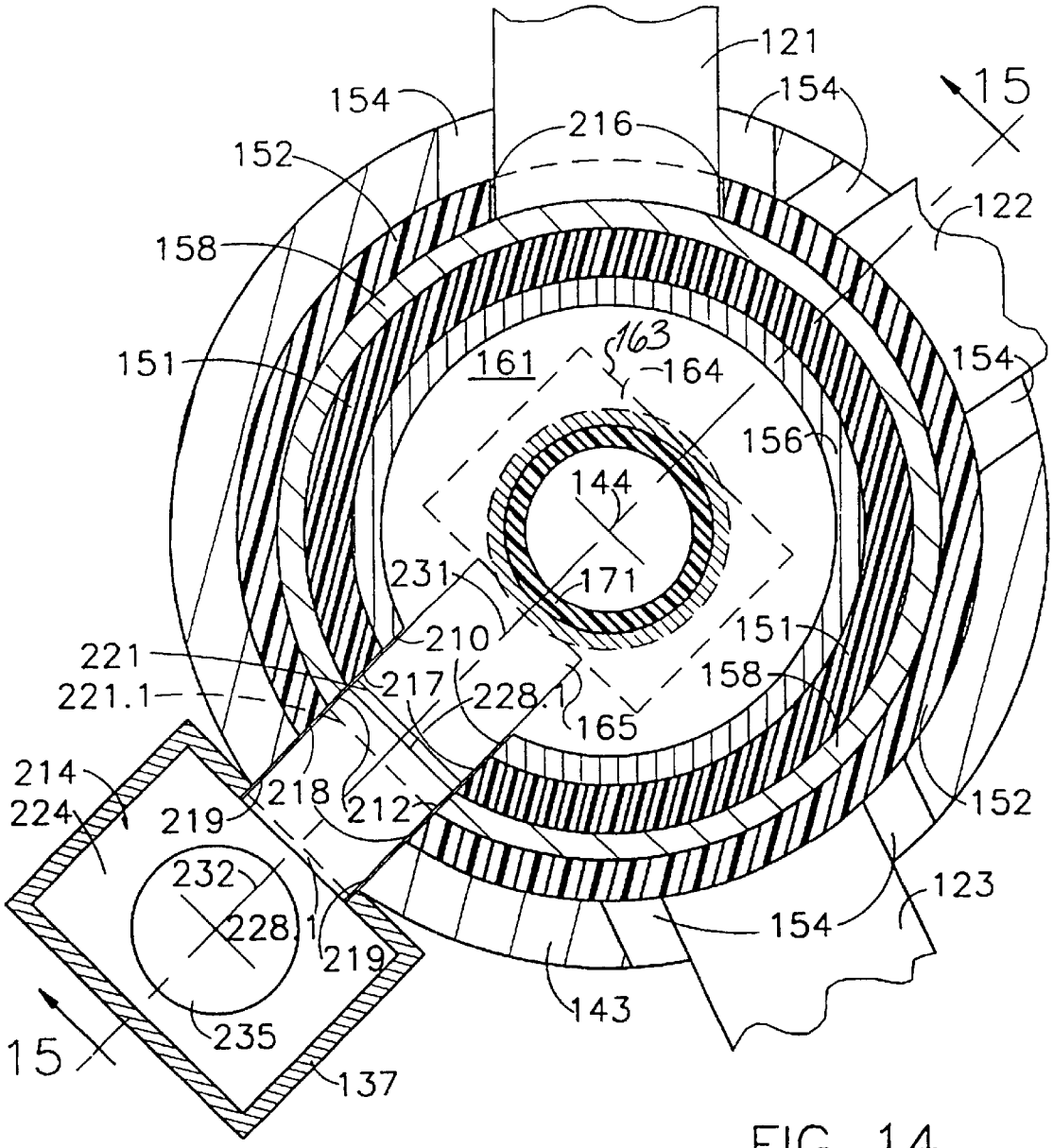
FIG. 14 is a simplified fragmented section on line 14—14 of FIG. 12 showing deadbolts of primary and secondary locks interfering with each other.

FIGS. 12 and 14, the primary lock casing 118 of the second embodiment 115 comprises an outer cylindrical casing 143 having an annular first end face welded to the interior face 14 of the door 10, and an annular second end face secured to a circular casing cover 145 by bolts, not shown. The casing 143 is concentric about a main axis of rotation 144 which extends perpendicularly to the faces of the door. The apparatus further includes first and second plastic discs 147 and 148 fitted adjacent the face 14 and an inner face of the cover 145 respectively so as to define opposite interior faces of the casing. First and second plastic journaling rings 151 and 152 are short tubes fitted within the interior of the casing, extend between the interior faces, and are concentric with the axis 144 and are equivalent to the first and second rings 83 and 85 of FIGS. 3 and 4. The second plastic ring 152 and outer cylindrical casing 143 have generally aligned clearance openings 153 and 154 to extend therethrough, the clearance openings for the arm 121 only being shown in FIG. 12. As seen in FIG. 14, the clearance openings 154 extend over arcs to accommodate limited rotation of the actuating arms through about 10 degress about the axis 144, and thus function similarly to corresponding openings 61 and 62 in FIG. 5.

The apparatus further includes a generally cylindrical inner ring member 156 and a larger, generally cylindrical intermediate ring member 158, the ring members 156 and 158 sandwiching the first plastic journalling ring 151 therebetween similarly to the ring members 65 and 67 of FIGS. 3 and 4. The second plastic journalling ring 152 is similarly sandwiched between the outer cylindrical casing 143 and the intermediate ring member 158. The ring members 156 and 158 and plastic journalling rings 151 and 152 and the discs 147 and 148 are all concentric with the axis of rotation 144 to reduce sliding friction during actuation of the apparatus and to reduce moisture, lubrication and static problems similarly to the previously described first embodiment.

The apparatus further includes a backing plate 161 and a conventional primary deadbolt lock 163, the deadbolt lock having a lock body 164 (shown in broken outline). Preferably, the deadbolt lock is a "Schlage"™ lock which has a lock cylinder 166 similarly to a Yale lock, but the deadbolt 165 has opposite end portions which extend on opposite sides of the body 164 depending on whether the deadbolt is extended or retracted. This type of lock is relatively thin and yet sufficiently secure and strong to perform the required function. The body 164 is secured by bolts directly to the backing plate 161 so that the lock cylinder 166 extends axially and concentrically with the axis 144 to an outer cylinder face 168 having a key opening 169 to receive a primary key 170 on an extension, see FIG. 15.

The lock cylinder 166 is surrounded by a plastic spacer sleeve 171 which in turn is fitted within a metal access sleeve 173. The sleeve 173 has an annular inner face which is secured by welding to the backing plate 161, and extends outwardly perpendicularly to an outer end face flush with the exterior face 19 of the door. The plastic sleeve 171 is a seal between the metal sleeve 173 and the lock cylinder 166 to prevent contamination. The access sleeve 173 has a pair of diametrically opposed engagement openings 175 located between the interior and exterior faces 14 and 19 of the door. For security, the engagement openings 175 are enclosed externally by a blanking sleeve 176 which isolates an interior space 177 between outer and inner panels of the door defining the outer and inner faces 19 and 14. The openings 175 are for engagement by an alignment tool 178 which is used by an operator to rotate the lock body as will be described. In this example the openings 175 are disposed on a vertical axial plane, but other orientation are also desirable to increase difficulty of access. The sleeve 173 and openings 175 thus serve as a tool receiver which is equivalent to the tool openings 77 of FIGS. 3 and 6. The alignment tool 178 thus functions essentially identically to the alignment tool 101 of FIGS. 8 and 9 but is more sophisticated to increase difficulty of duplicating the procedure which permits application of torque to the lock, for example by unauthorized operators trying to break in to the secured area.

Figure 13:
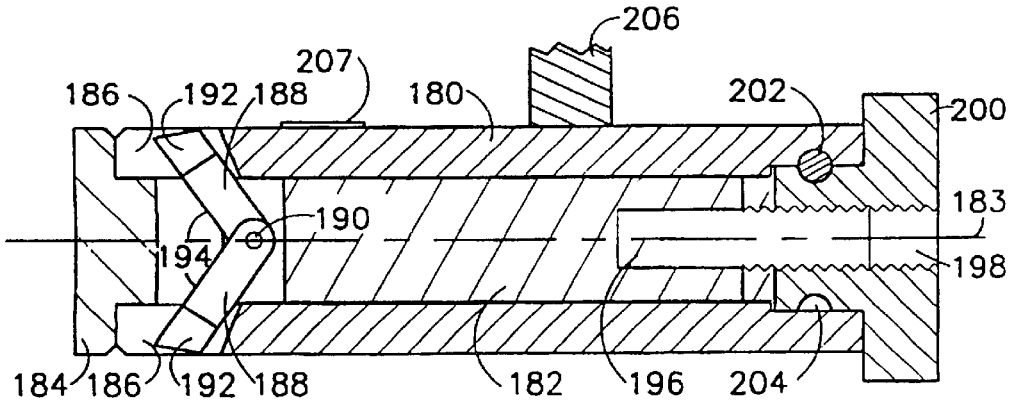
FIG. 13 is a simplified longitudinal section through the alignment tool only of FIG. 12, the tool being shown retracted for removal or insertion of the tool.

Referring also to FIGS. 12 and 13, the alignment tool 178 has a tubular outer body portion 180 and a cylindrical inner body portion 182 slidably fitted within the outer body portion and concentric with a body axis 183, which coincides with the axis 144 when the tool is fitted in an operative position in the apparatus as shown in FIG. 12. The alignment tool 178 further includes a distal end cap 184 which is fitted adjacent a distal end portion of the outer body portion 180. The outer body also has a pair of diametrically opposed dog clearance openings 186 which receive a pair of engagement dogs 188 which have inner ends hinged to a hinge pin 190 adjacent the distal end of the inner body portion 182. The dogs have equal lengths which are selected so that outer ends 192 of the dogs can be received in the engagement openings 175 of the sleeve 173 when the dogs extend fully and generally perpendicularly outwardly from the alignment tool as shown in FIG. 12. In this extended position, distal edges 194 of the dogs contact an edge of the end cap 184 which urges the dogs to the position shown in FIG. 12 so that the dogs are almost aligned with each other.

The inner body portion 182 has a spigot 196 extending fixedly therefrom and having a screw threaded outer end 198 which is received within a complementary screw threaded bore of a control knob 200. The control knob 200 is journalled adjacent a proximal end portion of the outer body portion 180 and is retained thereon by a straight retainer pin 202 which engages a circumferential groove 204 in a reduced portion of the control knob 200. The retainer pin extends as a chord through aligned openings in the outer body portion 180 and permits rotation of the control knob with respect to the outer portion but restricts axial movement with respect to the outer portion. It can be seen that rotation of the knob moves the spigot 196, and with it, the inner body portion 182, axially along the axis 183. As seen in FIG. 13, appropriate rotation of the knob draws the inner body portion 182 towards the proximal end sufficiently to cause the engagement dogs 188 to retract so that outer ends 192 do not project outwardly from the clearance openings 186 as shown in FIG. 13. Thus, in summary, FIG. 12 shows the alignment tool in an extended or operative position in which the dogs engage the openings in the access sleeve to permit application of torque to the sleeve as will be described. FIG. 13 in contrast shows the dogs of the tool in the retracted positions for insertion into, and removal from the access sleeve 173.

The alignment tool 178 has a manual lever 206 extending generally radially from the outer body portion 180 for gripping by an operator to apply torque to the outer body portion and thus rotational force to the dogs. The lever 206 is arranged to be at a fixed angle with respect to a radial axis of extension of the dogs. The portion 180 has an alignment marker 207 (e.g. a ridge or groove) which is preferably within a vertical plane containing the axis of the alignment tool and an axis of the lever 206 and also axes of the dogs. Thus, an operator can determine the location of the dogs with respect to the alignment tool based on the marker 207 and the lever 206.

The disc 139 on the exterior face 19 of the door (FIG. 10) has a plurality of graduations extending radially from the axis 144 and spaced circumferentially around a full revolution. Preferably, for simplicity, at least twelve equally spaced radial lines are used representing positions of the hours on a conventional 12-hour clock face. This enables an operator to align or orient the tool accurately by positioning the marker 207 to be aligned with a predetermined graduation on the disc.

As shown in FIG. 14, similarly to the first embodiment as shown in FIG. 4, the inner ring member 156 has a deadbolt clearance opening 210 which is aligned with the deadbolt 165. The intermediate ring member 158 has a similar deadbolt clearance opening 212 to receive the deadbolt 165 when aligned therewith and fully extended, not shown. The first and second plastic journalling rings 151 and 152 have corresponding clearance openings 217 and 218. The smaller first plastic ring 151 is a shrink fit on the inner ring member 156, and thus rotates with the inner ring member and the clearance opening 217 thereof maintains alignment with the clearance opening 210 of the ring member 156. In contrast, three arm clearance openings in the larger plastic ring 152 closely embrace the actuating arms 121, 122 and 123, one opening 216 for the arm 121 being shown. The arms secure the second plastic ring 152 relative to the intermediate ring member 158 so as to rotate therewith, in a manner similar to that previously described. The casing 143 has a clearance opening 219 adjacent the secondary casing 137 which is alignable with the clearance opening 218.

The primary deadbolt 165 has a distal end portion 221 which is shown in FIG. 14 in a partially extended position in which it extends partially through the aligned clearance opening 217, which represents a non-operative position as will be described. When fully extended the distal end portion assumes a broken outline position designated 221.1 at which time it passes completely through the clearance opening 210 and fully engages the intermediate ring member 158.

Figure 15:
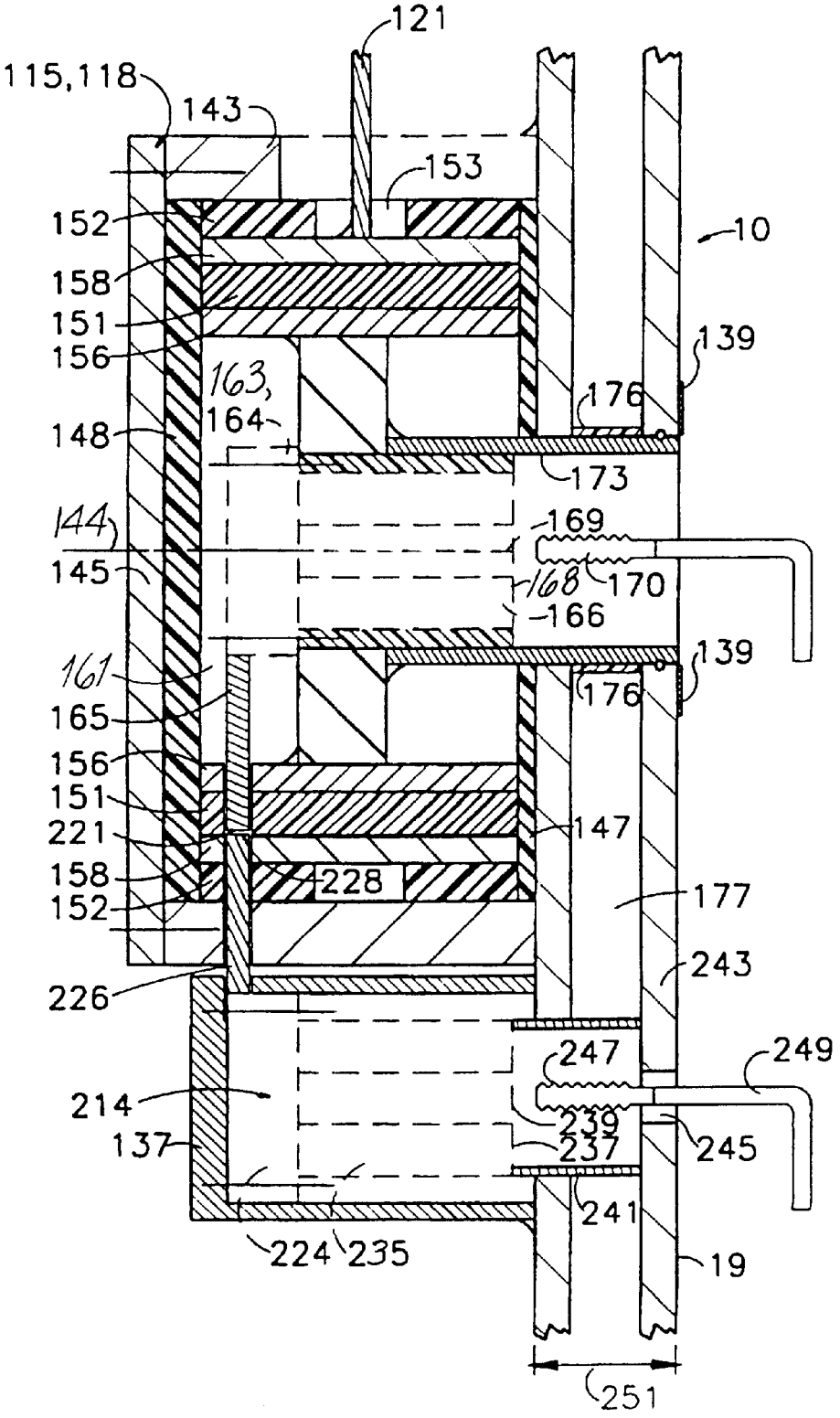
FIG. 15 is a simplified fragmented section generally on line 15—15 of FIG. 14.

In FIGS. 14 and 15, the secondary lock casing 137 contains the conventional secondary deadbolt lock 214 which has a secondary deadbolt 226 and can be a "Schlage"™ lock generally similar to the primary deadbolt lock 163 for compactness and strength. As seen in FIG. 15, a secondary lock body 224 is secured within the casing 137 so that the secondary deadbolt 226 is within a plane containing the primary deadbolt 165 of the primary deadbolt lock. Because the deadbolts 165 and 226 have essentially identical widths, the deadbolt 226 is also complementary to the clearance opening 212 in the intermediate ring member 158 and the clearance openings 218 and 217 in the plastic rings. The deadbolt 226 has a distal end portion 228 which is shown closely adjacent the distal end portion 221 of the primary deadbolt, and is received within the clearance opening 212. It can be seen that axes 231 and 232 of extension and retraction of the deadbolts 165 and 226 coincide with each other and intersect the axis 144 so that the deadbolts are seen to extend radially with respect to the lock casing 118. Thus the axis of extension 231 of the primary deadbolt can be aligned with the axis of extension 232 of the secondary deadbolt 226.

In the positions shown in FIGS. 14 and 15, the distal end portion 221 of the primary deadbolt interferes with the distal end portion 228 of the secondary lockbolt which prevents relative movement between the lock body of the primary lock and the lock body support, namely the intermediate ring member 158. Rotation of the intermediate ring member can only occur when the secondary deadbolt 226 is retracted sufficiently so that the distal end portion 228 thereof assumes a position disposed radially outwardly of an inner edge of the second plastic journalling ring 152. When the secondary deadbolt is retracted to broken outline portion 221.1, the primary deadbolt 165 can extend so that the distal end portion thereof reaches the broken outline position 221.1 and thus fully engages the clearance opening 212. In this position, relative rotation between the casing 143, and the intermediate ring member 158 with the second plastic journalling ring 152 is possible.

As best seen in FIG. 15, the secondary deadbolt lock 214 has a secondary lock cylinder 235 extending to an outer face 237 which has a key opening 239. An access tube 241 extends from a rear face of an outer door panel 243 (which provides the exterior face 19 of the door) to the face 237 of the cylinder 235 and is disposed concentrically of the cylinder. The panel 243 has an access opening 245 which is aligned with the key opening 239 but spaced therefrom to increase the difficulty of picking locks using conventional lock picking tools. The secondary lock is actuated by a secondary lock key 247 which is mounted at an end of an L-shaped key extension 249 which is aligned axially therewith so that both the key and the extension can just pass through the access opening 245. Thus, the access opening 245 is sufficiently large to receive the key 247 and extension 249 for accessing the key opening 239, but is sufficiently small to prevent manipulation of lock picking tools. The access tube 241 thus provides an access opening extending from the lock body face to an outside face of the door or other closure member, and is spaced therefrom by at least thickness 251 of the door. The small size of the opening 245 and spacing of the opening 245 from the key opening 239 increases difficulty of picking the lock.

Both the first and second embodiments of the invention have an additional advantage of providing a lock in which the deadbolt of the lock is not subjected to forces while the magazine is being transported. In blasting operations it is usual to transport the magazine to a convenient location, usually along rough roads on the back of a low-bed trailer, or by dragging the magazine on skids behind a vehicle. When the magazine is transported, the door must be maintained closed, and conventionally door closure is effected by the deadbolt. During transportation, the magazine is subjected to considerable forces from twisting, vibration, etc. which can cause the conventional deadbolt to fail or to jam in the lock, resulting in a broken lock or other difficulties in opening the lock when the magazine arrives at the desired location. A damaged magazine must be guarded continuously until a replacement lock is installed which can be costly. In contrast, the door 10 of the invention is maintained closed by the plurality of door bolts, and because the deadbolt of the primary lock is retracted when the door is locked, the deadbolt is not exposed to forces that twist the door of the magazine with respect to the frame. If the secondary lock is retracted during transportation, the door is free to shift slightly with respect to the frame, thus essentially eliminating transfer of extreme loads to the lock mechanism itself, thus preventing deadbolt failure or jamming that can occur with the prior art magazine locks as used above.

Operation of the second embodiment 115 follows procedure similar to that for the first embodiment 18 but has additional features which increase difficulty of forceful entry into the lock.

Initially, the control knob 200 of the tool 178 is rotated so that the engagement dogs 188 are fully retracted as shown in FIG. 13. As before, the operator must be aware of the angular spacing between the diametrically opposed engagement openings 175 of the sleeve 173 and the relative location of the clearance opening 212 in the intermediate ring 158 to enable correct operation of the lock. The operator visually inspects the inside face of the sleeve 173 to determine approximate location of the engagement openings 175, and then positions the tool so that rotation of the control knob 200 extends the dogs 188 outwardly to engage the access openings 175 as shown in FIG. 12. In this position, the tool is engaged for rotation of the sleeve 173 and thus the primary lock, but this rotation is prevented because of the deadbolt 226 of the secondary lock engaging the clearance opening 212. The operator inserts the secondary key 247 through the access opening 245 and into the key opening 239, and rotates the key. This rotation retracts the secondary deadbolt 226 from the clearance opening 212 so that the distal end portion 228 is spaced radially outwardly of the intermediate ring member to permit rotation thereof when engaged by the primary deadbolt.

The operator can now rotate the alignment tool by using the manual lever 206 which concurrently rotates the sleeve and primary deadbolt. The lever 206 and marker 207 now positioned at the correct angular orientation with respect to the door as determined by the clock-like graduations on the disc on the door. A clock face is chosen as a convenient means of remembering the specific angle at which the marker 207 must be set with respect to the face. In this example the lever is set at 12 o'clock and in this position the operator knows that the deadbolt 165 is now aligned with the opening 212 in the intermediate ring. The knob 200 is rotated in an opposite direction so as to retract the dogs 188 to permit the tool to be withdrawn from the access sleeve 173.

When the tool 178 is withdrawn from the sleeve, the primary key 170 is inserted into the key opening 169 and when the key is turned the deadbolt 165 extends so as to pass cleanly through the clearance opening 212 in the intermediate ring. In this position, there is sufficient clearance between the distal end portions of the primary deadbolt and the secondary deadbolt to prevent interference therewith and to permit easy rotation of the intermediate ring member 158 and all associated structure contained within that ring member. This rotation rotates the actuating arms 121, 122 and 123 a few degrees (e.g. about 10 degrees) in the clearances 154, which in turn withdraws the doorbolts (see FIGS. 10 and 11), from the openings, thus permitting the door of the magazine to be opened.

The door is locked by reversing the above procedure. Thus the alignment tool 178 is rotated in an opposite direction so as to extend the doorbolts so they engage the doorframe. The tool is then removed by retracting the dogs, and the primary key is inserted and turned in the key opening so as to retract the primary deadbolt. This permits relative rotation between the lock body and the intermediate ring 158 without moving the doorbolts which of course remain locked. Preferably, the secondary deadbolt is also extended into the clearance opening 212 of the ring member 158, so that the secondary bolt extends fully into the clearance opening 212 to further protect the door. Clearly, when the doorbolts are extended the secondary bolt can always be extended into the opening 212. If the secondary deadbolt is not extended, one aspect of the security of the lock is lost, but the lock can still function.

Clearly, in all instances the primary lock can only be actuated when the alignment tool 178 removed therefrom so as to expose the key opening 169. This contrast with the first embodiment 18 in which the key can be inserted through the opening 105 in the tool 101 (see FIGS. 8 and 9) while the tool is engaged with the opening 77 (see FIG. 3). Obstructing the primary key opening with the alignment tool further increases the difficulty of forceful entry into the lock because considerable extra time is required to overcome the lock. Thus, if an unauthorized person is trying to determine by trial and error the appropriate angle of the lever 206 which aligns the primary deadbolt with the clearance opening 212, each time the sleeve and the primary lock have been rotated by the tool, the tool must be removed to permit insertion of the primary key to determine whether or not the deadbolt is aligned with the clearance opening. This is time consuming and frustrating as there are many possibilities of the correct location of the lever within a full revolution.

An additional advantage relates to the interference between the secondary lock and primary lock which can occur if an unauthorized person is not aware of the correct sequence of opening the lock. For example, because the door is usually locked with the secondary deadbolt extended to engage the clearance opening 212, even if an unauthorized person has the primary key and is aware of the correct angle of the lever 206 but does not have the secondary key, the lock cannot be opened as the primary deadbolt cannot be fully extended to engage the clearance opening 212. Thus without somehow retracting the secondary deadbolt, opening of the door is not possible without complete breakage of the door.

What is claimed is:

1. A high security lock apparatus for controlling the position of a moveable doorbolt with respect to a door, the lock apparatus comprising:

(a) a primary deadbolt lock having a primary lock body and primary deadbolt extendable and retractable relative thereto;

(b) a lock body support co-operating with the primary lock body to permit relative movement therebetween when the deadbolt is retracted, the lock body support having a deadbolt clearance opening therein to receive the deadbolt when extended and aligned therewith to prevent said relative movement, the lock body support being operatively connectable to the doorbolt to selectively extend or retract the doorbolt when the deadbolt is extended and the lock body is moved; and (c) a secondary deadbolt lock to interfere selectively with the lock body support to prevent movement thereof, the secondary lock having a secondary lock body and a secondary deadbolt extendable and retractable relative thereto, the secondary deadbolt being complementary to the clearance opening of the lock body support so that the secondary deadbolt can be selectively received therein to prevent movement of the lock body support.

2. An apparatus as claimed in claim 1 further characterized by the primary deadbolt having an axis of extension and retraction which is alignable with an axis of extension and retraction of the secondary deadbolt.

3. An apparatus as claimed in claim 2 further characterized by the secondary deadbolt having a distal end portion, and the primary deadbolt having a distal end portion which can interfere with the distal end portion of the secondary deadbolt when said deadbolts are extended within the clearance opening, said interference preventing said relative movement between the lock body of the primary deadbolt and the lock body support.

4. An apparatus as claimed in any one of claims 1, 2 or 3 further characterized by the primary lock body being locatable within an access opening extending inwardly from an outer face of the door, the primary lock body having a key opening to receive a key, the access opening being sufficiently large to receive the key for accessing the key opening, but being sufficiently small to prevent manipulation of lock picking tools.

5. An apparatus as claimed in claim 4 further characterized by a tool receiver cooperating with the primary lock body and operable to receive a selectively separable alignment tool for generating said relative movement between the lock body and the lock body support to align the deadbolt with the deadbolt clearance opening in the lock body support prior to extending the deadbolt.

6. An apparatus as claimed in claim 5 further characterized by the tool receiver being an access sleeve locatable within the access opening and being secured to and extending from the primary lock body to the outer face of the door, the access sleeve being mounted for movement relative to the door in response to force applied to the access sleeve.

7. An apparatus as claimed in claim 6 further characterized by the access sleeve having at least one engagement opening therein to receive an engagement dog of the alignment tool to apply force to the access sleeve.

8. An apparatus as claimed in claim 6, further characterized by the key opening being located in the access sleeve and the alignment tool being receivable into the access sleeve so that the key opening is obstructed by the alignment tool to prevent insertion of the key thereinto, the key opening being located within the access sleeve.

9. An apparatus as claimed in claim 1 further characterized by the secondary lock body being locatable within an access opening extending inwardly from an outer face of the door, the secondary lock body having a key opening to receive a key, the access opening of the secondary lock being sufficiently large to receive the key for accessing the key opening of the secondary lock but being sufficiently small to prevent manipulation of lock picking tools.

10. An apparatus as claimed in claim 1 further characterized by the primary lock body being journalled for rotation relative to the lock body support.

11. An apparatus as claimed in claim 10, further characterized by the primary lock body being rotatable about a main axis and the lock body support being rotatable about the main axis and at least partially enclosing the primary lock body.

12. An apparatus as claimed in claim 11 further characterized by a generally cylindrical inner ring member secured to the primary lock body to rotate therewith, and the lock body support being a generally cylindrical intermediate ring member concentric with and journalling the inner ring member, the intermediate ring member having the deadbolt clearance opening.

13. An apparatus as claimed in claim 12 further characterized by the inner ring member extending around the lock body and having a deadbolt clearance opening to receive the deadbolt when the deadbolt extends from the lock body into the deadbolt clearance opening of the intermediate ring member.

14. An apparatus as claimed in claim 12, further characterized by an outer casing being securable to the door to journal the intermediate ring member therein.

15. An apparatus as claimed in claim 14, further characterized by first and second plastic journalling rings, the first journalling ring being disposed between the inner ring member and the intermediate ring member, and the second journalling ring being disposed between the intermediate ring member and the outer casing.

16. An apparatus as claimed in claim 14, further characterized by an actuating arm extending laterally from the intermediate ring member and moveable within a plane generally adjacent and parallel to an interior face of the door, the actuating arm being connectable to the doorbolt to actuate the doorbolt upon rotation of the lock body support.

17. An apparatus as claimed in claim 16, further characterized by the outer casing having a clearance opening to receive the actuating arm extending therethrough.

18. An apparatus as claimed in claim 17, further characterized by the main axis being disposed generally perpendicularly to the door and the actuating arm extending generally normally to the main axis.

19. A high security lock apparatus for securing to an item, the apparatus comprising:

(a) a deadbolt lock having a lock body and a deadbolt extendable and retractable relative thereto;

(b) an inner ring member which is concentric with a main axis and is secured to the lock body to mount the lock body therewithin to essentially enclose the lock body;

(c) a lock body support comprising an intermediate ring member which is concentric with the main axis and co-operates with the inner ring member to permit unlimited relative rotation therebetween about the main axis in either direction when the deadbolt is retracted, the intermediate ring member having a deadbolt clearance opening therein to receive the deadbolt when aligned therewith and extended into the clearance opening to fix the lock body with respect to the lock body support to prevent said relative rotation;

(d) a first journal for journalling the lock body for rotation relative to the intermediate ring member, the first journal being disposed between the inner ring member and the intermediate ring member;

(e) an outer casing which is concentric with the main axis and co-operates with the intermediate ring member to permit relative rotation therebetween about the main axis, the outer casing essentially enclosing the intermediate ring member and being securable to the item; and (f) a second journal for journalling the intermediate ring member relative to the outer casing, the second journal being disposed between the intermediate ring member and the outer casing, the second journal being spaced radially outwardly from the first journal so as to substantially enclose the first journal.

20. An apparatus as claimed in claim 19, further characterized by:

(a) the first journal being plastic, rotating with the inner ring member, and having a deadbolt clearance opening to receive the deadbolt extended therethrough; and (b) the second journal being plastic and rotating with the intermediate ring member.

21. An apparatus as claimed in claim 19, further characterized by a tool receiver cooperating with the lock body and operable to receive a selectively separable alignment tool for selectively rotating the lock body.

22. An apparatus as claimed in claim 21, further characterized by the tool receiver being an access sleeve secured to and extending from the lock body, the access sleeve being rotatable with the lock body relative to the item in response to torque applied to the access sleeve.

23. An apparatus as claimed in claim 22, further characterized by the lock body having a key opening operable to receive a key for controlling the deadbolt, and the access sleeve being adapted to receive the key for accessing the key opening, but to prevent manipulation of lock picking tools.

24. An apparatus as claimed in claim 19, further characterized by an actuating arm extending from the intermediate ring member, and the outer casing having a clearance opening therein, the clearance opening receiving the actuating arm to permit limited rotation of the intermediate ring member relative to the outer casing.

25. An apparatus as claimed in claim 24, further characterized by a doorbolt link extending from the actuating arm to a doorbolt to operatively connect the doorbolt and actuating arm together to actuate the doorbolt following the rotation of the intermediate ring member.

26. An apparatus as claimed in claim 25, further characterized by an engagement structure mounted on the doorbolt link to receive an emergency tool to actuate the link independently of actuation of the deadbolt lock.

27. An apparatus as claimed in claim 21, further characterized by a selectively separable alignment tool having an outer end complementary to the tool receiver for cooperating therewith to permit application of torque to the lock body by an operator gripping and rotating the alignment tool to rotate the lock body.

28. An apparatus as claimed in claim 23, further characterized by a selectively separable alignment tool having an outer end complementary to the access sleeve for cooperating therewith to permit application of torque to the lock body by an operator gripping and rotating the alignment tool to rotate the lock body, the alignment tool being receivable into the access sleeve so that the key opening is obstructed by the alignment tool to prevent insertion of the key thereinto.

29. An apparatus as claimed in claim 22, further characterized by the access sleeve having at least one engagement opening therein, and a selectively separable alignment tool having an outer end receivable into the access sleeve for cooperating therewith, the alignment tool having at least one extendable and retractable engagement dog which is extendable from the alignment tool to engage the engagement opening of the access sleeve to apply torque thereto to rotate the lock body.

30. An apparatus as claimed in claim 21, further characterized by a secondary deadbolt lock to interfere selectively with the intermediate ring member to prevent movement thereof, the secondary lock having a secondary lock body and a secondary deadbolt which is extendable and retractable relative to the secondary lock body, the secondary deadbolt being complementary to the deadbolt clearance opening of the intermediate ring member so that the secondary deadbolt can be selectively received therein to prevent said movement.

31. An apparatus as claimed in claim 30, further characterized by the primary deadbolt having an axis of extension and retraction which is alignable with an axis of extension and retraction of the secondary deadbolt.

* * * * *